US005790013A

United States Patent [19]

Hauck

[11] Patent Number: 5,790,013

[45] Date of Patent: Aug. 4, 1998

[54] ELECTRONIC NOVELTY DEVICE AND METHOD OF USING SAME

[76] Inventor: Lane T. Hauck, 5346 Bragg St., San Diego, Calif. 92122

[21] Appl. No.: 538,819

[22] Filed: Oct. 4, 1995

[51] Int. Cl.[6] ..... G08B 5/00

[52] U.S. Cl. ..... 340/332; 340/815.73; 472/57; 472/61; 362/802

[58] Field of Search ..... 340/332, 330, 340/331, 815.4, 815.47, 815.48, 815.73; 472/51, 57, 72, 61; 362/802

[56] References Cited

U.S. PATENT DOCUMENTS 5,188,565 2/1993 Hauck ..... 472/51

*Primary Examiner*—Edward Lefkowitz
*Attorney, Agent, or Firm*—Bernard L. Kleinke; Peter P. Scott

[57] ABSTRACT

A novelty device and method of using it, include at least three lamp sockets, and at least three lamps, which are each capable of producing at least three different colored lights, such as red, green and orange light. The lamps are housed in opaque translucent enclosures or housings, to prevent their colors from being known until they are illuminated by a set of at least three corresponding manually operable switches. When the switches are actuated, the lamps each emit a different colored light to provide the appearance that each lamp is of a different color. A control device in the form of a microprocessor secretly enables the user to cause the lamps to emit the desired color even after the lamps are removed from the sockets, mixed, and then re-inserted.

10 Claims, 8 Drawing Sheets

ELECTRONIC NOVELTY DEVICE AND METHOD OF USING SAME

TECHINICAL FIELD

The present invention relates in general to an electronic novelty device, and a method of using it. The invention more particularly relates to such a novelty device, which is also capable of functioning as a magic trick.

BACKGROUND ART

Novelty devices have been employed for many years for the purpose of entertaining people. Such novelty devices have included loops and rings, which are linked together in such a manner that the operator can quickly and easily disconnect them. However, the spectator, when asked to perform such a feat, is unable to duplicate it.

While such devices are amusing, they are not always very challenging to more sophisticated or educated persons. In this regard, adults may not find such a novelty item or puzzle to be very amusing or challenging. Such an adult may well be able to quickly and easily determine the secret for solving the puzzle by a mere visual inspection in a relatively short period of time. Thus, it would be highly desirable to have a novelty device which is very entertaining, and not subject to learning the secret to solving the puzzle in a ready manner, even by sophisticated adults who may have technical education or experience.

Such novelty devices have included magical apparatus used by magicians in performing magic tricks on the stage. For example, there have been remotely controlled devices employing radio frequency signals to enable the magician performer to activate secretly a device at a distance. However, such an apparatus is not at all susceptible to examination by the audience, without revealing the secret of its operation. certainly, an engineer or scientist could readily inspect such an apparatus and determine exactly how it operates. The radio transmitter or receiver would be apparent by visual inspection, and the thought process of the more sophisticated spectator could readily analyze the device to determine the nature of its operation. Thus, it would be highly desirable to have a novelty device which is constructed and arranged such that its operation is not readily susceptible to detection by an audience, including highly trained and skilled persons who might otherwise be able to analyze and determine the nature of the operation of the device.

Many magic tricks have been operable only in the hands of a skilled magician, which raises the natural suspicion that the magician is controlling the trick in some way unknown to the audience. It would be highly desirable to have a novelty device which exhibits its baffling and entertaining properties in the hands of the spectators, with the magician apparently taking no part in the process.

Some magic tricks require the magician to perform a covert operation to enable the trick to function in a desired manner, and then to perform another covert operation to disable the part of the trick that he or she desires to conceal from discovery by the audience. In this manner, the device can subsequently be examined by the audience, without detecting the secret of the baffling mode of operation. It would be preferable to have a novelty device that functions identically, whether in the operator's hands or in the spectator's hands, with no change of operating mode, and yet enable the operator to cause the device to operate in an unexpected and unusual manner, which cannot be duplicated by the spectators.

Magic tricks made for professional magicians often require special skill, such as sleight-of-hand, to operate. It would be desirable to have a trick device, which is easily operable by people of ordinary skill, including children. Ideally, such a device should appeal to all age groups.

In the hands of children, it would be very desirable if the device requires mental dexterity to operate, so that its secret cannot be discovered accidentally, or by chance. Parents prefer to give their children toys and games that require some mental dexterity to operate, to stimulate thinking. Thus, it is highly desirable to have a novelty device, which not only may be employed as a magic trick, but also may be used as an educational or otherwise amusing and entertaining toy or puzzle. Such a device should require some skill to operate, but the required skill should require a general mental acuity only. No specialized or difficult skill such as sleight-of-hand performed by skilled magicians, should be required. Thus, such a device could be used by a wide range of ages of operators.

It would be very desirable if such a device were portable and could be manufactured at relatively low cost. With suitable packaging, such a device should be marketable as a unique and somewhat expensive desk accessory or a coffee table conversation piece.

DISCLOSURE OF INVENTION

Therefore, the principal object of the present invention is to provide a new and improved novelty device and method of using it, wherein a technically unsophisticated operator can operate the device in a baffling and entertaining manner, without permitting a technically experienced person to discover how the novelty device functions.

A novelty device and method of using it, include at least three lamp sockets, and at least three lamps, which are each capable of producing at least three different colored lights, such as red, green and orange light. The lamps are housed in opaque translucent enclosures or housings, to prevent their colors from being known until they are illuminated by a set of at least three corresponding manually operable switches. When the switches are actuated, the lamps each emit a different colored light to provide the appearance that each lamp is of a different color. A control device in the form of a microprocessor secretly enables the user to cause the lamps to emit the desired color even after the lamps are removed from the sockets, mixed, and then re-inserted.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
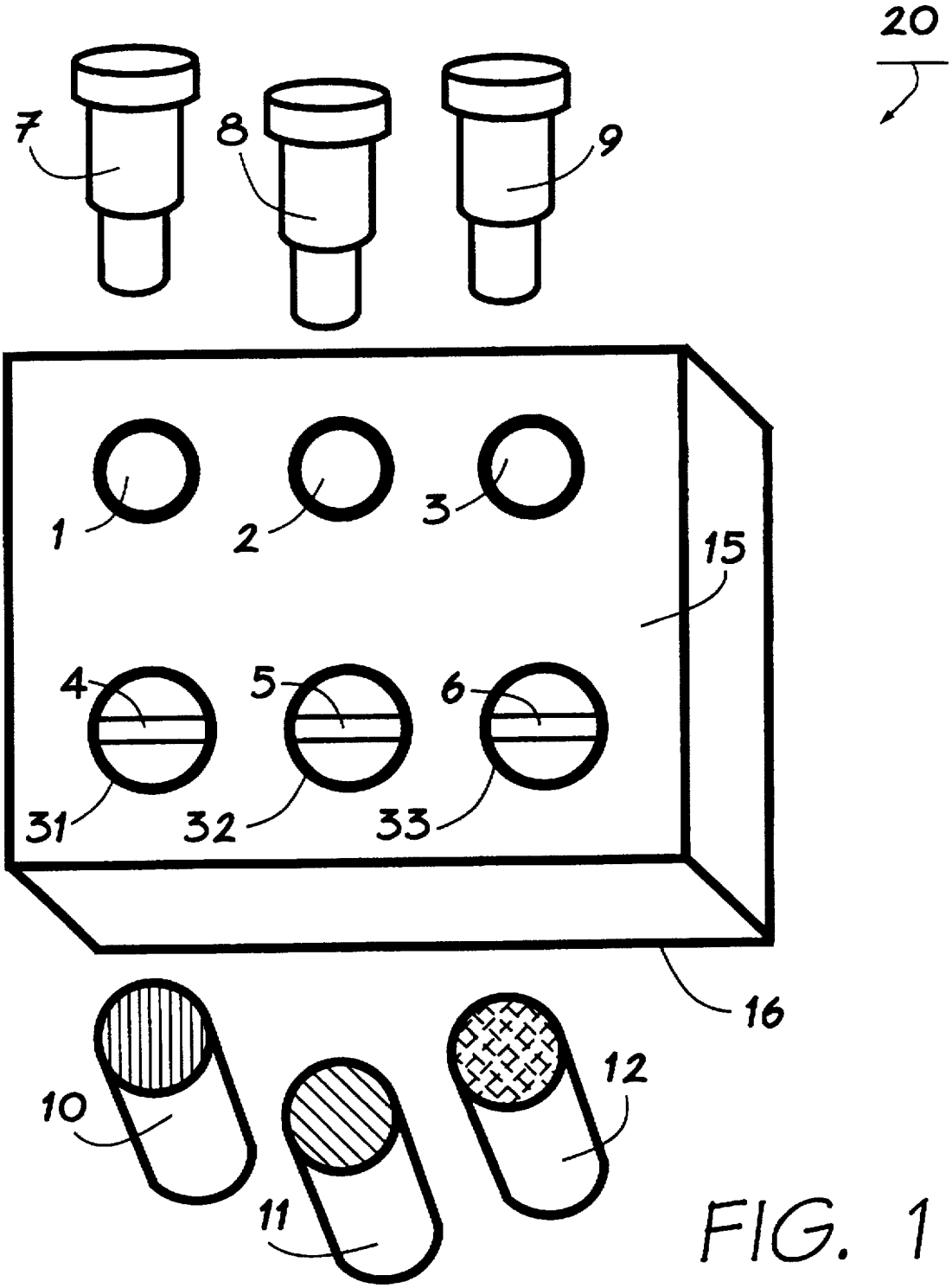
FIG. 1 is a pictorial view of a novelty device which is constructed in accordance with the present invention, showing the device prior to its use.
Figure 2:
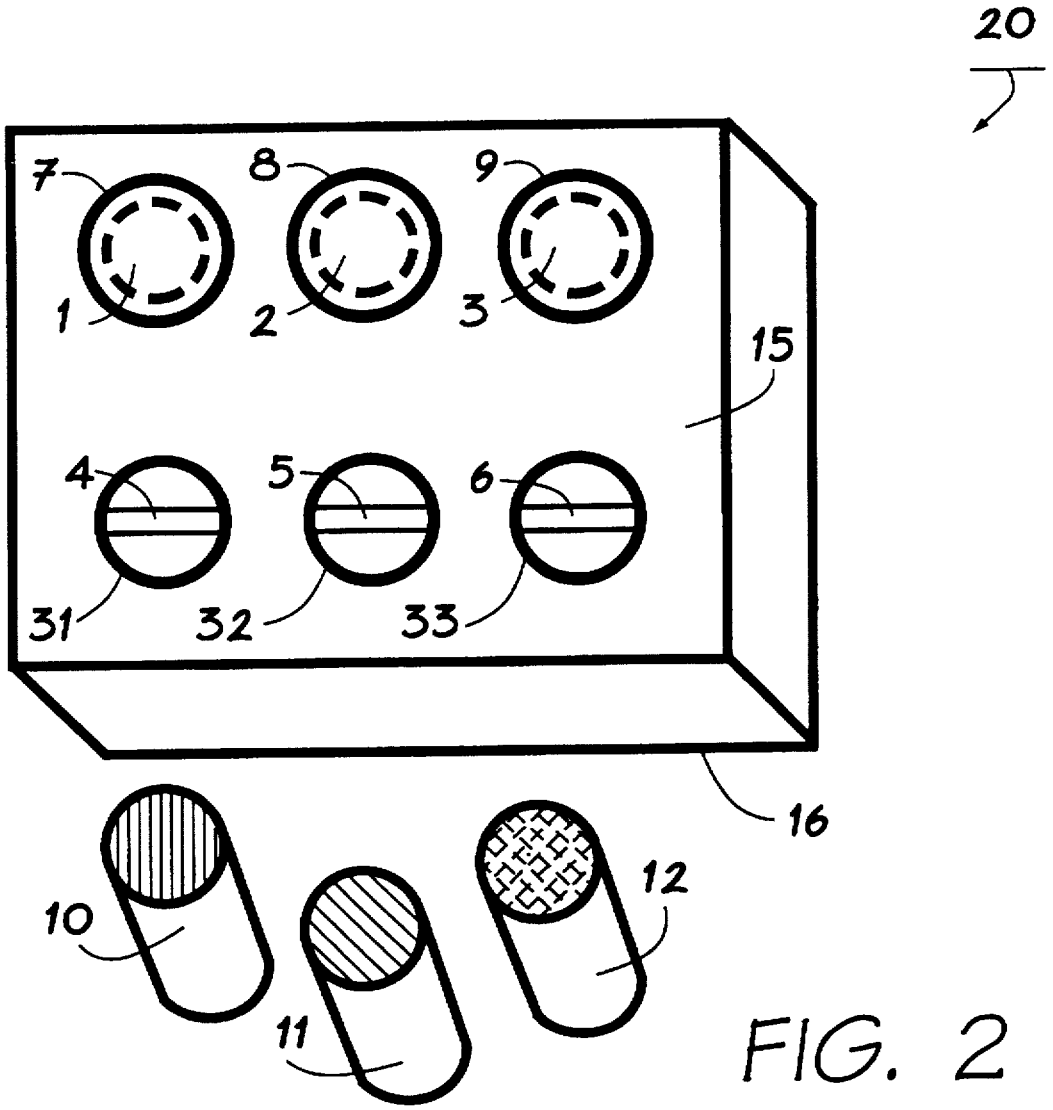
FIG. 2 is a pictorial view of the device of FIG. 1, after placement of the three lamps.
Figure 3:
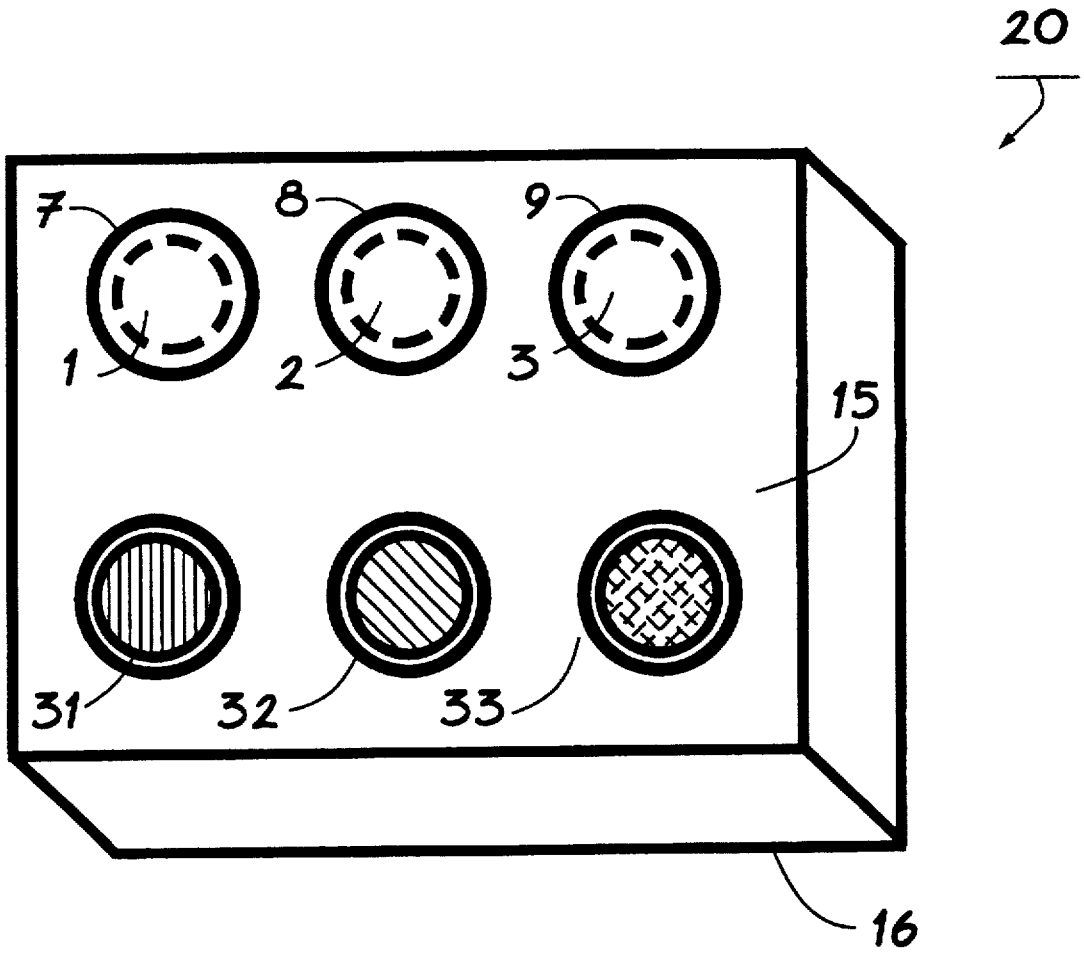
FIG. 3 is a pictorial view of the device after placement of the colored pushbuttons.

Referring now to FIGS. 1, 2 and 3, there is illustrated a novelty device 10, which is constructed in accordance with the present invention. Referring to FIG. 1, device 20 generally comprises a playing surface 15 of a housing 16 containing three identical receptacles or electrical sockets 1, 2 and 3, and three identical manually operable switches 4, 5 and 6 disposed within the housing 16 below a set of three holes or openings 31, 32 and 33, respectively. Three like lamps 7, 8 and 9 are enclosed in opaque translucent housings, such that the color of each unpowered lamp cannot be observed. The lamps 7–9 can be inserted into respective receptacles 1, 2 and 3 in any order. Three like identical pushbutton tops 10, 11 and 12 are colored red, green and orange, respectively. The pushbuttons are designed to fit through the respective holes and extend into engagement with the switches 4, 5 and 6, and when depressed manually by the user, they actuate the respective switches.

Each of the lamps 7–9 is capable, when illuminated, of providing three different colors, red, green and orange. The pushbuttons 10–12 each bear a different color, namely red, green and orange, respectively. However, the actual color of any lamp is not discernible until it is plugged into one of the receptacles or sockets 1–3 and its corresponding pushbutton switch is pressed to illuminate its lamp. In FIG. 1, the switch 4 controls the lamp in receptacle 1, the switch 5 control the lamp in the receptacle 2, and the switch 6 controls the lamp in the receptacle 3. In this regard, each one of the switches controls the corresponding lamp receptacles 1–3 disposed adjacent thereto.

In operation, a spectator is invited to mix up the lamps 7–9, and then to insert them individually into any desired ones of the receptacles 1–3 in any desired order (FIG. 2). Although FIG. 2 shows lamp 7 in receptacle 1, lamp 8 in receptacle 2, and lamp 9 in receptacle 3, the lamps could be placed in any of six possible combinations. The spectator is lead to believe that each one of the lamps is different in that each one emits a different colored light when illuminated. However, in reality, the three lamps 7–9 are similar to one another and each one is capable of emitting all three colors of light, as hereinafter described in greater detail, even though the opaque housings prevent the spectator from knowing in advance which color will be emitted prior to illumination.

Once the three lamps 7–9 are placed into receptacles 1–3, the operator attempts to place the pushbuttons 10–12 through the holes 31–33 into engagement with the three switches 4–6 so that each colored pushbutton is placed opposite a lamp emitting its corresponding colored light. Once inserted, the operator presses the pushbuttons 10–12, actuating the switches underneath the pushbuttons, and to the amazement of the spectators, achieves a match of pushbutton and lamp colors. Furthermore, the operator can accomplish this matching every time the above sequence of events is repeated.

Many variations of device operation are possible. For example, the operator can employ more than one spectator, asking spectator No. 1 to insert the lamps in any desired order, and then asking spectator No. 2 to correctly match the pushbuttons to the lamps. Spectator No. 2 will probably not be able to accomplish the match. However, the operator can secretly cause the match to be made each time, without the spectators knowing. In a group of spectators, one of the spectators achieve a perfect match every time under the secret control of the operator (magician), while others do not, is quite mysterious and vexing, especially when the operator has no apparent influence over the placement of the pushbutton by the spectator, who is freely inserting the pushbuttons into any one of the holes in the housing.

Another variation is that the operator can place the pushbuttons over the switches first, and then have the spectator plug in the lamps in any order, and still achieve a perfect match.

The device operates in the manner described due to two special properties not known to the spectators and only known to the operator magician. Firstly, each lamp is capable of illuminating in any one of three colors; namely, red, green or orange. Secondly, there is a microprocessor 100 (FIG. 6) inside the housing and is responsive to the three switches 4–6. The microprocessor 100 can detect if the lamps are plugged in or not. The microprocessor 100 is capable of powering each lamp in three different modes of operation to cause a lamp to turn on with the red, green or orange color.

For description purposes, the following terminology is adopted. The placement of lamps and pushbuttons and the verification of pushbutton-lamp colors is referred to as a "round." A round constitutes three phases, the "lamp placement" phase, the "pushbutton placement" phase, and the "test" phase.

The first phase in a round is the lamp placement phase, during which the three lamps are removed, scrambled, and handed to the spectator to re-insert them in any order. Once the lamps are inserted, the lamp placement phase is over and the pushbutton placement phase begins. In the pushbutton placement phase, the operator places the pushbutton onto the switches. Then the test phase commences, during which the operator presses the pushbuttons to test whether or not the pushbutton colors match the lamp colors. The act of removing the three lamps terminates the check phase and initiates the next lamp placement phase.

During the test phase of a round, as the operator or spectator presses the pushbuttons to illuminate the lamps and check the correspondence of pushbutton colors to lamp colors, the operator watches carefully to note which of the switches is released last. In this regard, the colors red, green and orange are associated by the operator with the corresponding holes 31, 32 and 33, respectively. Whichever one of the switches corresponding to its hole 31, 32 or 33 is released last prior to the removal of all of the lamps, determines the color of light of the first switch actuated during the next round when all of the lamps are reinserted in any order, under the control of the microprocessor 100.

For example, if the switch 4 (FIG. 1) is released last, then the operator remembers the color red as being associated with the left hand hole 31 in the row of holes. If the switch 5 is released last, then the operator remembers the color green. If switch 6 is released last, then the operator remembers the color orange. The secret to the device operation is that the color that is ascertained by watching the order of switch releases will be the "starting color" for the next round, where the "starting color" is the color of light emitted by a lamp corresponding to the first switch pressed in the test phase of the next round.

Suppose the last pushbutton released as the switch/lamp colors are tested is the middle switch 5 in FIG. 1. This corresponds to the starting color of green. After the lamps are removed and replaced, a new pushbutton placement phase commences during which the operator places the pushbuttons over the switches. Then a test phase commences to check the pushbutton and lamp colors. The first pushbutton pressed will illuminate the corresponding lamp green, since green is the starting color that was ascertained from the previous round. This is true regardless of the placement of the green pushbutton. In other words, the operator can place the green pushbutton over any of the three switches 1, 2 or 3, and as long as the first pushbutton pressed during the test phase is the green pushbutton, the associated lamp will be powered by the microprocessor 100 in the green state, since the microprocessor is so programmed.

The operator then secretly makes use of the knowledge that the pushbutton switches should be tested in a predetermined sequence, for example according to Table I.

TABLE I

| Starting color | Second color | Third color |
|---|---|---|
| red | green | orange |
| green | orange | red |
| orange | red | green |

For the present example, with green as the starting color, the second switch pressed illuminates its lamp as orange, and the third switch pressed illuminates its lamp as red.

As another example, suppose the last switch released is the left switch 4, establishing red as the starting color. The lamps are removed, scrambled and re-inserted. The operator places the pushbuttons anywhere and presses first the red pushbutton, then the green pushbutton, and last the orange pushbutton. Because the colors were pressed in the correct order, the pushbutton and lamp colors match, regardless of where the pushbuttons were actually placed (which ones of the holes 31–33).

It is possible to vary the technique used to press the pushbuttons in the correct order. For example, if red is the starting color, the operator can first place the red pushbutton and press the underlying switch before placing the other two pushbuttons. Then the green pushbutton can be placed and actuated, and then the orange. This technique is very useful when the operator wishes to create the illusion that the operator is somehow magically controlling the spectator to cause him or her to place the pushbuttons in the proper holes to match the pushbuttons with the lamps. As long as the operator hands the pushbuttons to the spectator in the right order as determined by the microprocessor 100, and the spectator inserts and presses each pushbutton before being handed the next pushbutton, the operator can insure that the spectator presses the pushbuttons in the correct order, thus successfully matching the pushbutton and lamp colors. Alternatively, the operator can cause a different spectator to fail to correctly match the colors by handing the pushbuttons in an incorrect order. Therefore the operator has complete control over who matches and who does not match the colors.

As another example, suppose the starting color is orange, because the last switch released before the lamps were unplugged, was switch 6. The operator places the pushbuttons orange, red, green. Then the lamps are removed, scrambled and replaced. The operator then presses the orange pushbutton, then the red pushbutton, and then the green pushbutton, thus illuminating the correct colors. Actually, the pushbuttons could be placed in any sequence of the holes 31–33, as long as the operator presses first the orange, then the red, and then the green pushbuttons in sequence.

An important aspect of the device is that once the pushbuttons have been pressed in the correct order as described above, the switches subsequently may be pressed in any order, individually or simultaneously, any number of times, and the pushbutton-lamp color relationships that were established for the first three presses remain in effect. This ability convinces the spectator that each lamp emits a different colored light, and thus each lamp is a different color.

Also, during the test phase, once a pushbutton is pressed to determine the color of its lamp, the same pushbutton may be pressed repeatedly before pressing another pushbutton, and the lamp will continue to illuminate with its assigned color. It therefore appears that the pushbuttons are indeed "hard-wired" to their corresponding lamps.

Figure 4:
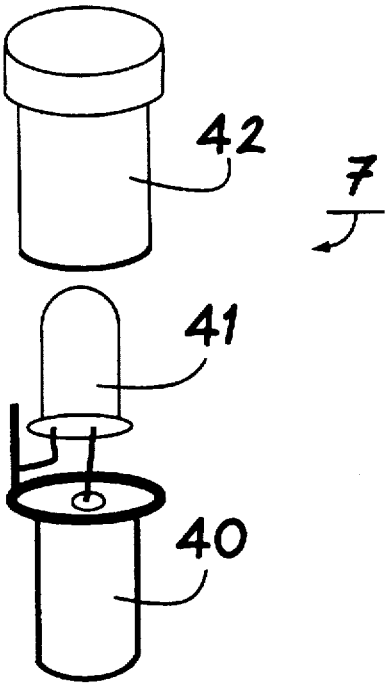
FIG. 4 is an enlarged diagrammatic view of a lamp shown partially disassembled.

Addressing now the first special property, the like multicolored lamps 7–9 will now be considered. FIG. 4 shows the construction of one of the lamps, the other two lamps not being described further as they are similar. A plug 40 is a conventional two terminal plug, and is in the form of a coaxial power jack. A light emitting diode (LED) 41 is connected electrically to the two terminals of plug 40. A translucent shroud or housing 42 fits over the assembly and is opaque to conceal the diodes from view, and yet permit the light to illuminate the housing 41, when either one or both of the diodes are energized.

Figure 5:
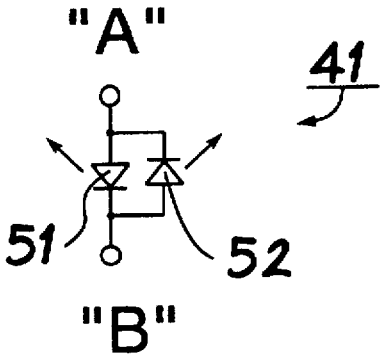
FIG. 5 is a schematic diagram of the lamp of FIG. 4.

FIG. 5 illustrates the LED 41 in schematic form. The LED package actually contains two LED devices, connected electrically back-to-back in parallel. One of the LED devices is red (51), and the other is green (52). Applying a positive voltage to A with respect to B causes current to flow through diode 51 but not through diode 52, resulting in the red LED 51 turning on. Conversely, applying a positive voltage to B with respect to A causes current to flow through diode 52 but not through diode 51, resulting in the green LED 51 being activated. Also, applying an AC voltage across A and B, which rapidly reverses the polarity of the applied voltage, causes both LED 51 and LED 52 alternately to turn on emit orange colored light. If the frequency of the applied AC voltage is greater than about 40 Hz, no flicker is perceived, and the LED 41 appears to be a single-color orange lamp. If the duty cycle of the applied AC voltage is 50%, the resulting color is a third color, which is a mixture of the two LED colors, and in the preferred form of the invention in the color orange.

The LED 41 is conventional, and is marketed by QT Optoelectronics, 610 North Mary Ave, Sunnyvale, Calif. 94086, as model MV5491A bicolor solid state lamp, which includes two light emitting diodes with wavelengths of about 568 and about 650 nanometers, thereby providing the colors green and red, and causing the mixed color to be of the average wavelength of about 609 nanometers, which is the color orange.

Figure 6:
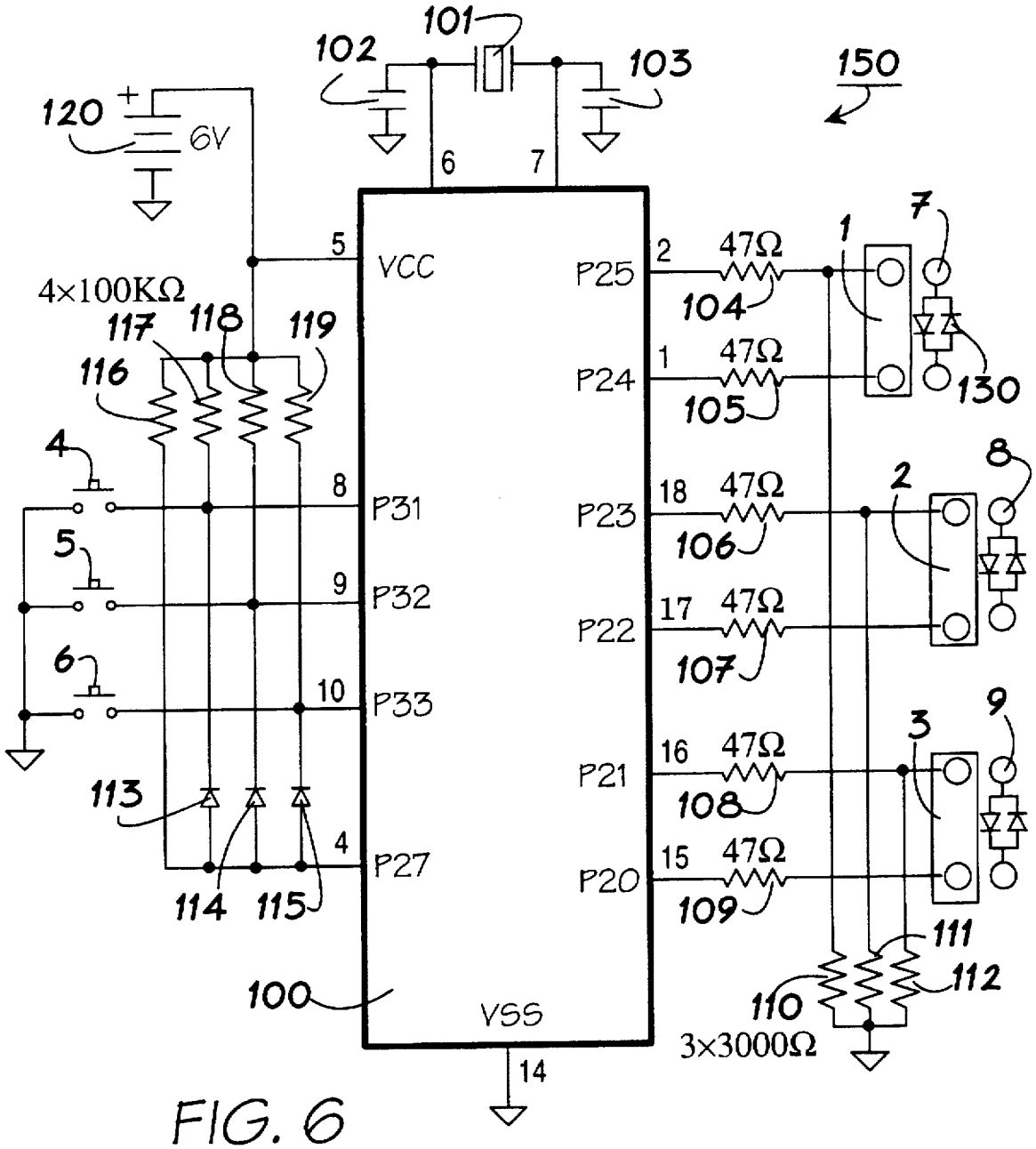
FIG. 6 is a schematic diagram of the device of FIG. 1.
Figure 7:
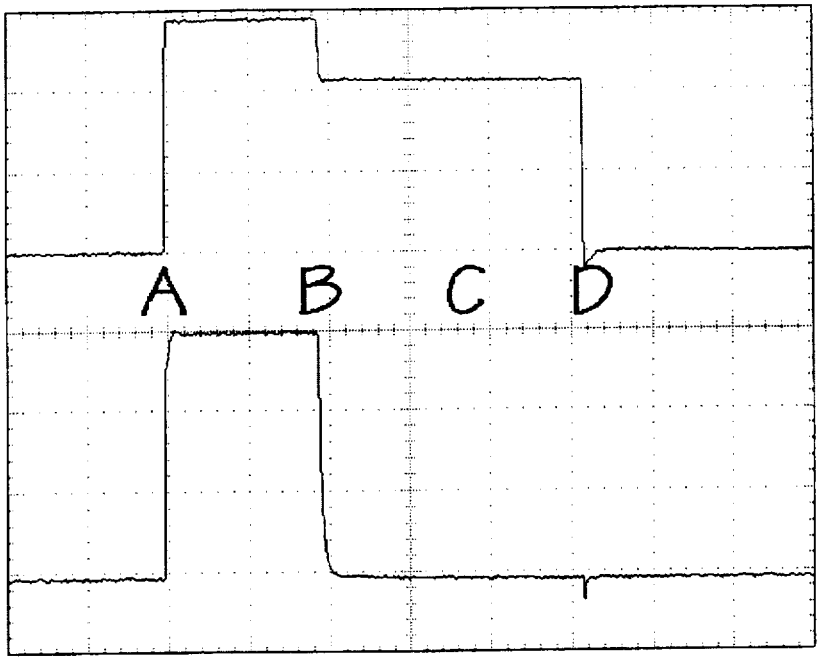
FIG. 7 is a graph of an oscilloscope trace illustrating one aspect of the operation of the device of FIG. 1.
Figure 8:
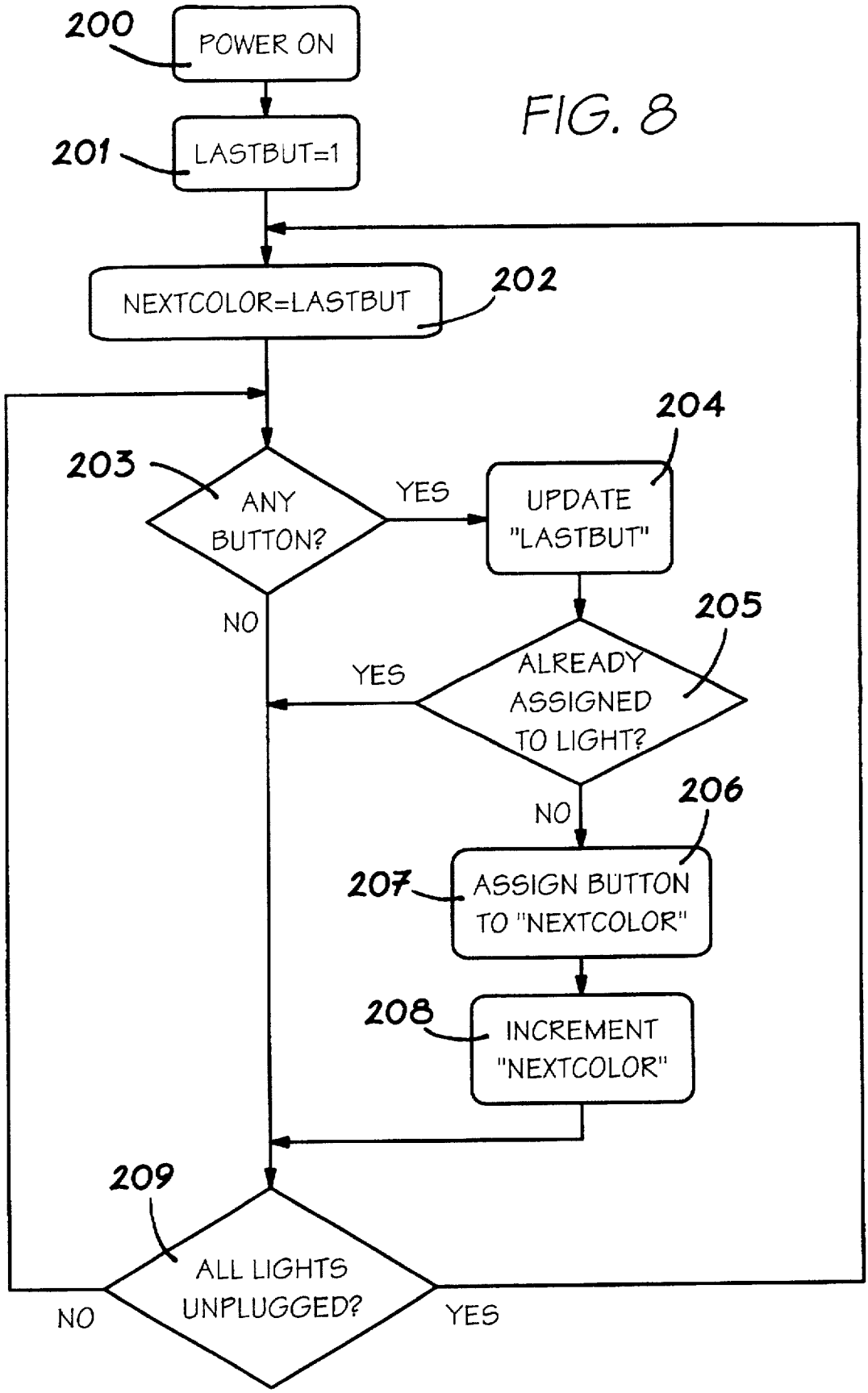
FIGS. 8 and 9 are flowchart diagrams illustrating the logic flow for the computer program used by the microprocessor of the device of FIG. 1.
Figure 9:
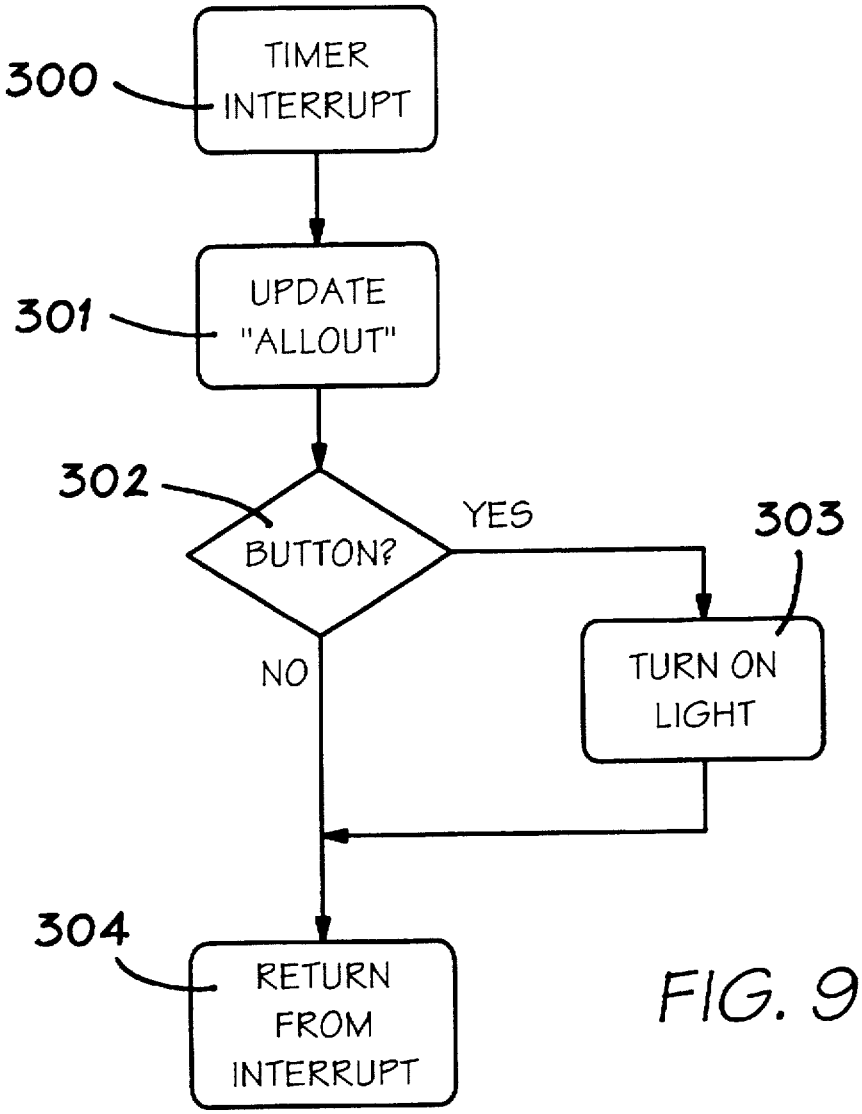

Addressing the second special property, the microprocessor 100 and program therein, FIG. 6 is a schematic diagram for the device electronics. FIG. 7 is an oscilloscope graph of an LED drive signal used to determine whether or not a lamp is plugged in, and FIG. 8 is a flowchart for the microprocessor background program. FIG. 9 is a flowchart for the microprocessor interrupt routine.

Turning now to FIG. 6, there is shown a schematic diagram of the control circuit 150 for the device 20. The microprocessor 100 is controlled by a computer program shown in FIGS. 8 and 9. Microprocessor 100 is a Zilog Z86E04, a single chip processor with an Electrically Programmable ROM (EPROM), or a Z86C04, which uses a masked ROM. This processor, which is a member of the Zilog Z8 family, is described in the Zilog data book DC 8318-01, entitled *Discrete Z8 Microcontrollers,* dated Q2/94, incorporated herein by reference as if fully set forth herein.

A crystal 101 establishes a precise internal clock frequency for the microprocessor 100. A pair of capacitors 102 and 103 provide the proper loading for crystal 101. One contact of lamp receptacle 1 is connected to microprocessor port pin P25 through current limiting resistor 104, and the other contact of lamp receptacle 1 is connected to microprocessor port P24 through current limiting resistor 105. One contact of lamp receptacle 2 is connected to microprocessor port pin P23 through current limiting resistor 106, and the other contact of lamp receptacle 2 is connected to microprocessor port P22 through current limiting resistor 107. One contact of lamp receptacle 3 is connected to microprocessor port pin P21 through current limiting resistor 108, and the other contact of lamp receptacle 3 is connected to microprocessor port P20 through current limiting resistor 109.

Each of the port pins can be programmed to be an input or output pin by the computer program 100. Load resistors 110, 111, 112 are used to complete the circuit to ground when the lamps are unplugged, allowing the microprocessor 100 to determine if a lamp is inserted or removed from the receptacle. The lamp assemblies 7, 8 and 9 are shown for reference as plugging into receptacles 1, 2 and 3.

Momentary pushbutton switch 4 is connected to microprocessor port P31, and also to a pull-up resistor 117 which insures that the state of the P31 pin is high when the pushbutton is not pressed, and also to diode 113 which is used to form a logical "NOR" signal at microprocessor port pin P27. This "NOR" signal, formed by the three diodes 113, 114, 115 and resistor 116, goes low when any of the three pushbuttons is pressed. The "NOR" signal is used to command the microprocessor 100 to exit a low power "sleep" mode whenever a pushbutton is pressed. Momentary pushbutton switch 5 is connected to microprocessor port P32, and also to pull-up resistor 118 and diode 114. Momentary pushbutton switch 6 is connected to microprocessor port P33, and also to pull-up resistor 119 and diode 115.

The device is powered by a battery 120, which is in the form of four standard "AA" penlight cells. By making use of the microprocessor's low-power sleep mode, the device can automatically turn itself off after about 10 minutes of inactivity (no pushbuttons pressed), dropping the quiescent current consumption to about 50 microamps, and making a power switch unnecessary. The lack of a power switch adds to the impression that there is nothing in the device except switches, lamps and a battery.

The purpose for the load resistors 110, 111 and 112 will now be described. The microprocessor 100 must have some means for detecting when all lamps are unplugged, so that it knows when to begin a new round. Every 65 milliseconds, the microprocessor sends a very brief test pulse to each receptacle to check for the presence of a lamp. Although all three receptacles are tested at once, for clarity only the port connected to receptacle 1 will be described.

P25 and P24 are normally set to function as output pins, which drive high or low to activate the lamp 7. When it is time to test for the presence of a lamp, the microprocessor 100 first saves the state of the p24 and p25 output pins. Then it re-programs P25 to function as an input pin, and drives P24 high. If no lamp is plugged in, resistor 110 pulls the voltage of the unconnected input pin P25 to ground and the microprocessor program reads the state of P25 as "0."

If a lamp is plugged in, a circuit is completed from P24 (at approx. 6 volts) through the diode 130 and load resistor 110. This causes the voltage seen by P25 to be a diode drop below 6 volts minus voltage drops due to resistors 105 and 110, which is approximately 4.2 volts, which represents a logic 1 to the input pin P25. Thus P25 reads a "0" if the lamp is unplugged and "1" if it is plugged in.

FIG. 7 illustrates a typical waveform for P25 during the time that the presence of a lamp is checked. The top trace corresponds to a lamp that is plugged in, and the bottom trace corresponds to an unplugged lamp. Point "A" indicates the moment that P24 drives high, "B" indicates the moment that P25 becomes an input port, "C" indicates the moment that the processor tests the state of P25, and "D" indicates the moment that the pins P24 and P25 are returned to their normal (output) states. It can be seen that a plugged-in lamp presents a logic HI at time C in the top trace, and an unplugged lamp presents a logic LO at time C in the bottom trace.

The sequence of program steps to test for the lamps is shown in Appendix A, which is a complete listing of the program that executes in microprocessor 100. The state of port 2 is saved in statement 196, the pins are reprogrammed as a mixture of inputs and outputs in statements 197–198, the state of the input pins are tested in statement 199, and the ports are restored as outputs in statements 200–201. The time interval that each lamp is illuminated is very small, and the current through the LED is also very small, so any lamps that are plugged in are not observable as "on" during the time that the microprocessor checks for the presence of plugged-in lamps.

The program logic flow is diagrammed in FIG. 8 which is a flowchart for the main program, and FIG. 9 which is a flowchart for the interrupt routine.

Turning now to FIG. 8, there is shown a flowchart for the program in Appendix A. The program initializes at 200, when the power is turned on by plugging in the batteries. At 201 the variable LASTBUT which holds a number indicating the last pushbutton released is set to 1. The values of LASTBUT are red=1 (corresponding to switch 4 in FIG. 1), green=2 (switch 5 in FIG. 1) and orange=3 (switch 6 in FIG. 1). At 202 the variable NEXTCOLOR is set to the value of LASTBUT. This establishes red as the starting color for the round, but only for the first round after power is applied. The possible values of NEXTCOLOR are the same as for LASTBUT, namely red=1, green=2, orange=3.

The program then proceeds to 203, where a check is made to see if any pushbuttons are depressed. If none of the pushbuttons are depressed the program proceeds to 209, where a test is made to ascertain if all lamps are unplugged. This test is accomplished by examining the variable ALLOUT, which is updated in the interrupt service routine. If all of the lamps are not unplugged the program loops back to 203, where the pushbuttons are again tested.

If any pushbuttons are down at 203, the program branches to 204, where the variable LASTBUT is updated to reflect the pushbutton or pushbuttons pressed. When all pushbuttons are up, the update at 204 does not occur, and thus LASTBUT holds the state of the last pushbutton that was down before all pushbuttons were up, i.e. the last pushbutton released.

A check is then made at 205 to determine if the pushbutton being pressed has already been assigned a lamp color. If it has, the program proceeds to 209. If the pushbutton has not been assigned a lamp color (it is being pressed for the first time in a round), it is assigned the lamp color held in the variable NEXTCOLOR. The variable NEXTCOLOR is then updated (in the subroutine UPDATE_NEXTCOLOR, Appendix A lines 160–170) by incrementing the value 1 to 2, the value 2 to 3, or the value 3 to 1.

If all of the lamps are unplugged at 209, the program branches to 202, where the value of LASTBUT is copied into the variable NEXTCOLOR. This is how the last pushbutton pressed becomes the beginning color for the next round.

Turning now to FIG. 9, there is shown a flowchart for an interrupt service routine. The microprocessor 100 contains a timer circuit that is initialized to interrupt the main program every 5.12 milliseconds (Appendix A, lines 85–99). At 300 the interrupt service routine is entered. At 301 the lamp receptacles are tested for the presence of lamps, and the variable ALLOUT is set to 1 if all lamps are unplugged, and to 0 otherwise. Then the pushbuttons are checked at 302 to see if any are depressed, and the corresponding lamp is turned on for each depressed pushbutton at 303. If a pushbutton has not yet been assigned a color, its lamp is not activated. The interrupt service routine exits at 304, returning the microprocessor to its background program (FIG. 8).

The variable TOGMASK is complemented every time the interrupt service routine is activated (every 5.12 milliseconds), and this value is used to drive the orange colored lamp. This drives the lamp with the 50% duty cycle signal required to turn on both LEDS to produce the mixed third color (orange).

Appendix A is a fully commented listing of the microprocessor program.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A novelty device, comprising:

a set of at least three electrical sockets;

a set of at least three electrical lamp units for electrical connection to individual ones of the set of sockets, each one of the lamp units having lamp means being selectively illuminated in any one of at least three different colors when electrically connected to any one of said sockets and having a translucent opaque housing concealing said lamp means from view to reduce the possibility of a spectator determining that the lamp unit is capable of producing more than one color of light;

power means for energizing electrically said sockets;

a set of at least three electrical switch devices for being actuated to help control the energizing electrically of corresponding ones of said sockets by said power means;

control means responsive to said lamp units being removed and reconnected into said sockets and to said switch devices being activated for in turn causing said power means to activate corresponding ones of said lamp means to produce selected ones of said three colors of light individually, said control means causing each one of the reconnected lamp means to produce a different one of said at least three different colors in a sequence of colors of lights according to the order said switch devices are activated, said sequence starting with the color corresponding to the last switch device being released prior to the reconnection of all of said lamp means.

2. A novelty device according to claim 1, wherein each one of said switch devices includes a removable pushbutton switch actuating element and a switch, said pushbutton element bearing a color corresponding to one of said three colors.

3. A novelty device according to claim 1, wherein said control means includes a microprocessor.

4. A novelty device according to claim 2, further including a housing, said housing having said lamp receiving sockets mounted thereon and having means defining holes adjacent to corresponding ones of said sockets for receiving said pushbutton elements therethrough.

5. A novelty device according to claim 4, wherein said switches are mounted within said housing opposite individual ones of said holes to enable the pushbutton elements to extend through individual holes and engage operatively individual ones of said switches.

6. A novelty device according to claim 1, wherein said lamp devices each include a pair of light emitting diodes for producing at least two differently colored lights, said diodes being connected electrically in parallel in opposite polarities, and an opaque translucent housing conceals the diodes from view.

7. A novelty device according to claim 6, wherein one of said diodes produces red colored light, and the other diode produces green colored light.

8. A novelty device according to claim 7, wherein said control means energizes either said one diode only to produce red light, or said other diode only to produce green light, or both of said diodes to produce orange light.

9. A novelty device according to claim 6, wherein said control means causes either one or both of said diodes to be energized selectively to produce three different colors.

10. A method of operating a novelty device, comprising:

using a set of at least three lamps, each one of which is capable of producing three different colored lights and has An opaque translucent housing to conceal the color producing ability from view by a spectator;

inserting the lamps in a set of electric sockets;

activating momentarily at least three switches corresponding in dividually to said sockets;

determining a sequence of colors of lights to be produced by the lamps according to the order said switches are activated, and controlling the illumination of the lamps to produce at least three different colored lights corresponding to said sequence, the first color in said sequence depending upon which one of the switches was released last immediately preceding the removal and re-insertion of all of the lamps into the sockets.

* * * * *

UNITED STATES PATENT AND TRADEMARK OFFICE

CERTIFICATE OF CORRECTION

PATENT NO. : 5,790,013
DATED : August 4, 1998
INVENTOR(S) : Lane T. Hauck

It is certified that error appears in the above-indentified patent and that said Letters Patent is hereby corrected as shown below:

Column 10 Line 45 Should be "has an" not "has An"

Column 10 Line 49 Should be "individually" not "in dividually"

Column 10 Line 53 Should be "activated; and" not "activated, and"

Signed and Sealed this

Twenty-third Day of November, 1999

*Attest:*

Q. TODD DICKINSON

*Attesting Officer*

*Acting Commissioner of Patents and Trademarks*